US005377360A

United States Patent [19]

Fleitman

[11] Patent Number: 5,377,360

[45] Date of Patent: Jan. 3, 1995

[54] DECORATIVE, COMFORTABLE, ULTRA-ABSORBENT SWEATBAND

[76] Inventor: Jeffrey P. Fleitman, 1426 Pacific Ave., #1, Venice, Calif. 90291

[21] Appl. No.: 71,661

[22] Filed: Jun. 2, 1993

[51] Int. Cl.[6] ..... A42C 5/02

[52] U.S. Cl. ..... 2/181; 2/171; 2/181.4; 2/DIG. 11

[58] Field of Search ..... 2/170, 171, 181, 181.4, 2/183, DIG. 11, 918

[56] References Cited

U.S. PATENT DOCUMENTS

| | | | |
|---|---|---|---|
| 4,394,782 | 7/1983 | Wassan | 2/181.4 |
| 4,499,741 | 2/1985 | Harris | 2/181 |
| 4,520,510 | 6/1985 | Daigle | 2/DIG. 11 |
| 4,521,922 | 6/1985 | Mitchell | 2/171 |
| 4,993,080 | 2/1991 | Doty | 2/DIG. 11 |
| 5,025,504 | 6/1991 | Benston | 2/181.4 |
| 5,058,211 | 10/1991 | Hanks | 2/171 |

FOREIGN PATENT DOCUMENTS

| | | | |
|---|---|---|---|
| 3620506 | 6/1987 | Germany | 2/DIG. 11 |

*Primary Examiner*—Clifford D. Crowder
*Assistant Examiner*—Diana L. Biefeld
*Attorney, Agent, or Firm*—Ashok K. Janah

[57] ABSTRACT

A sweatband comprises an elongated, decorative, cloth element made of a stretchable material, and a water-absorber retained by the cloth element. The cloth element has end portions that can be secured together so that when the sweatband is placed around a body part, the band is held in place so the water-absorber can absorb sweat from the body part. The sweatband has a combination of comfort, high sweat absorbance.

16 Claims, 1 Drawing Sheet

DECORATIVE, COMFORTABLE, ULTRA-ABSORBENT SWEATBAND

BACKGROUND

This invention is directed to sweatbands of the type used by athletes in exercising.

Sweatbands, such as headbands and wristbands, are commonly used by athletes to absorb perspiration, and to a lesser degree, to keep hair out of the eyes. A common sweatband is formed of a double layer of a stretchable, terry cloth-like material, which can be stretched to conform to different size heads and wrists. and absorbs sweat.

A difficulty with this type of sweatband is it can be too loose over small heads and small wrists, such as those of children. In addition, this type of sweatband can be too snug when used by large sized adults. Moreover, with use, the elasticity of the stretchable material gives way, and the snugness is lost with the result that the sweatband can slide out of position. Further, conventional sweatbands are uncomfortable when stretched over headphones and other music-generating devices used by many exercisers.

Another disadvantages of conventional sweatbands is that they can be singularly unattractive. The patent attorney writing this application has been accused by his fashion-conscious teenage daughters of looking like a "dork" when jogging with a conventional sweatband stretched over stereo earphones. As is evident from apparel worn at most exercise classes, the fashion attractiveness of exercise clothes is important to many exercisers.

Rather than wearing unsightly headbands, some exercisers take a bandanna, roll it up, and tie it around their head. Although this can be effective in keeping hair out of the eyes, these headbands absorb very little sweat, with the result that a serious exerciser can have sweat dripping into and stinging the exerciser's eyes. Moreover, the headbands are held in place merely by a knot tied at the back, and this knot can easily come lose, resulting in the bandanna slipping out of position. This can become a serious problem when the headband slips over the eyes just at the time the exerciser is about ready to return a forehand in tennis or shoot a critical jump-shot in basketball.

Accordingly, there is a need for a comfortable, adjustable, highly absorbent, and attractive sweatband.

SUMMARY

The present invention is directed to sweatbands that meet this need. A sweatband according to the present invention comprises an elongated, decorative, cloth element and a water-absorber retained by the cloth element. The cloth element is made of a material capable of transmitting water, and has opposed end portions, which are sufficiently long to extend around a body part such as a wrist or a head. The water-absorber is soft and comfortable when worn, and sufficiently flexible to conform to the body part. The band can be placed around the body part and the cloth element end portions can then be secured together so that the band can absorb sweat from the body part, sweat transmitting through the cloth element into the water-absorber.

Typically the cloth element is formed of a stretchable material, such as a combination of spandex and a fibrous material. Dependant upon the material utilized, the cloth element can also absorb sweat as well as transmit sweat. Typically the cloth element comprises a tubular portion that contains the water-absorber, which can be a relatively flat piece of open cell synthetic foam.

It has been noted that at the interface between the end of the water-absorber and the cloth element, the cloth element can have an unsightly pucker, i.e., a wide spot, when the sweatband is wrapped around the body part. In order to avoid this problem, preferably the end portions of the cloth element are tapered, being widest proximate to the water-absorber, and the water-absorber end portions are also tapered.

The cloth element end portions can be secured together by tying them together. More preferably, the end portions are provided with connectors, such as a strip of Velcro brand synthetic material that can be fastened to itself.

The present invention overcomes disadvantages of prior art sweatbands because it is formed from two separate elements, namely the cloth element and the water-absorber. The water-absorber can be chosen to maximize water absorption, without concern for aesthetics, because it is covered by the cloth element. Thus, the water-absorber can be much more absorbent than the present conventional sweatbands. Additionally, the water-absorber can be a soft flexible material that when placed against the body, gives the wearer a cushioned feeling, similar to a pillow resting on the forehead or wrist. The cloth element can be made decorative to display sharp, clear images and designs. For example, the cloth element can be formed from a cloth segment rolled to resemble a rolled bandanna. Moreover, the sweatband can be easily adjusted to precisely fit the wrist or head to provide maximum comfort to the user.

DRAWINGS

These and other features, aspects and advantages of the present invention will become better understood from the following description, appended claims, and accompanying drawings where:

DESCRIPTION

Figure 1:
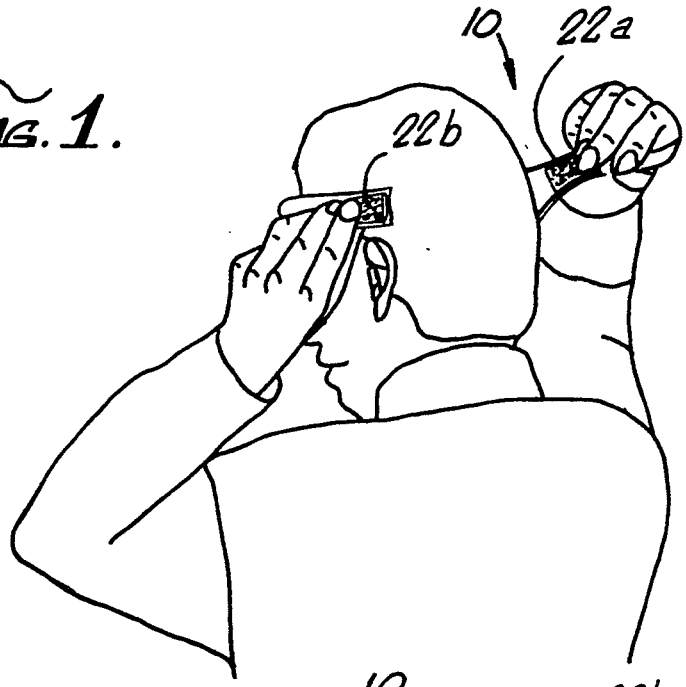
FIG. 1 is of a perspective view showing a sweatband according to the present invention being placed around the head of the user.
Figure 2:
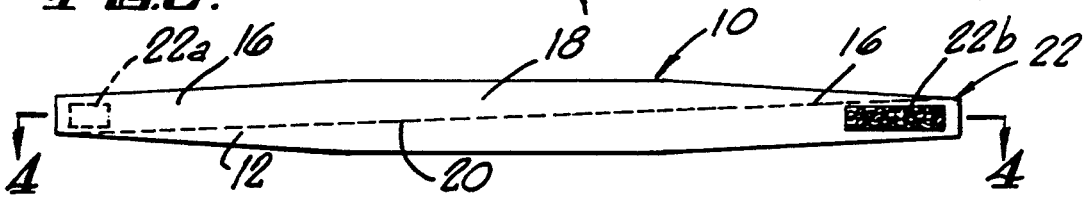
FIG. 2 is a rear plan view of the sweatband of FIG. 1.

A sweatband 10 according to the present invention is sized to be wrapped around a head, as shown in FIG. 1. The sweatband comprises a cloth element 12 and a water-absorber 14 retained by the cloth element 12. The cloth element 12 comprises opposed end portions or tails 16 and a retaining portion 18 therebetween. The retaining portion 18 retains the water-absorber 14.

The cloth element 12 can be formed from a cloth segment that is stitched, as shown by stitching 20, so that the retaining portion 18 is tubular, having an operative portion in which the absorber 14 is retained.

Figure 4:
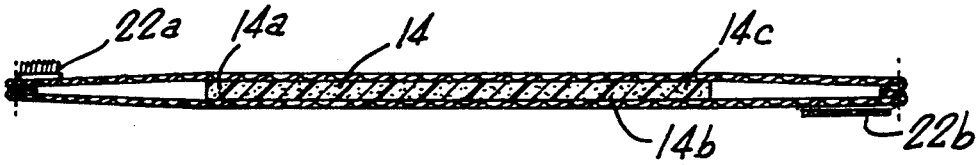
FIG. 4 is a longitudinal section view of the sweatband of FIG. 1 taken on line 4—4 in FIG. 2.

Preferably the stitching is on the back side of the headband so that it is not seen. As shown in FIG. 4, all or a portion of the cloth material can be folded over to give a double layer and cover the stitching.

The cloth element end portions 16 can be sufficiently long that they can be tied together to secure the sweatband 10 in place. Preferably the distal ends of the end portions 16 are provided with strips 22 of a synthetic material that can be fastened to itself, such as Velcro brand fasteners. Preferably the Velcro fastener strips 22 are sufficiently long to provide adjustability in the length of the sweatband 10. This method of attachment is preferred since the user can easily adjust the sweatband to precisely fit the body part to provide maximum contact to the user. As shown in the Figures, the hook side **22*a* of the Velcro fastener strips 22 can be shorter than the receiving side 22*b* of the Velcro fastener strips 22**.

Figure 3:
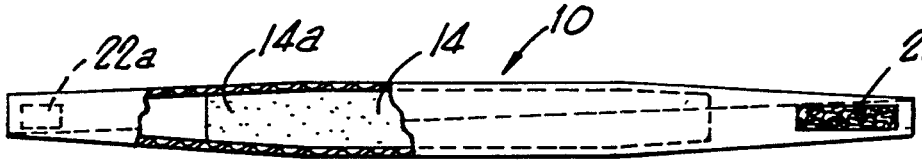
FIG. 3 is a rear plan view of the sweatband of FIG. 1, partially cut away to show the internal water-absorber.

It has been discovered that the cloth element can unattractively pucker or gather, i.e. become wide in a region proximate to the ends of the water-absorber 14. In other words, when the sweatband is placed in position, the region adjacent to the water-absorber 14 can look like a snake that has swallowed a mouse. To overcome this aesthetic problem, preferably the end portions **14*a* of the water-absorber 14 are tapered, as best shown in FIG. 3. Likewise, preferably the cloth element end portions 16 are tapered, being widest adjacent to the retaining portion and gradually tapering towards the fastener strips 22**.

The cloth element 12 is made of a water transmissive material. Additionally, the cloth element 12 can be made of a water absorbent material. Preferably that material is stretchable to provide adjustability in the length of the sweatband and provide a snug, comfortable fit. Stretchability can be obtained by using an elastic material such as spandex, in combination with synthetic or natural fibrous materials. The fibrous material can be cotton, wool, acrylic, polyester, rayon, acetate, triacetate, nylon, and combinations thereof. Specific combinations that are suitable for sweatbands are 90% cotton/10% Lycra brand (Du Pont de Nemours, E. I. & Co., Wilmington, Del.) spandex; 80% nylon/20% Lycra; 85% nylon/15% Lycra; and 55% cotton/35% polyester/10% Lycra.

The cloth material can be any decorative material desired. It can be any color and have any pattern imprinted on it. Thus, users can color coordinate their headband and wristbands with the remainder of their exercise outfit. Preferably, the material utilized will display clear, sharp images and designs.

The water-absorber 14 preferably has a flat exterior surface **14*b* for aesthetic reasons and a flat interior surface 14*c* for comfort. The water-absorber 14 typically has a thickness of about 1/16 to about ½ inch, and a width of from about ½ inch to about 3 inches, and preferably from about 1 inch to about 1½ inches. The water-absorber 14 is generally shorter in length than the cloth element, to provide the cloth element tails 16 to fasten the sweatband 10** in place.

The water-absorber, preferably, is made of a water-absorbent, comfortable, soft, flexible material that can conform to the shape of a body part. It can be made of natural sponge, or more typically, made of a synthetic foam material. Among the foam materials that are satisfactory are those described in Harper, Charles A. (editor), *Handbook of Plastics and Elastomers*, McGraw-Hill, New York (1975), chapter 7 by Barito, R. W. et al. which is incorporated herein by reference. Such materials include open cell polyurethane foam, polyvinyl chloride foam, foam rubber, phenolic foam, urea formaldehyde foam, and cellulose acetate foam.

Figure 5:
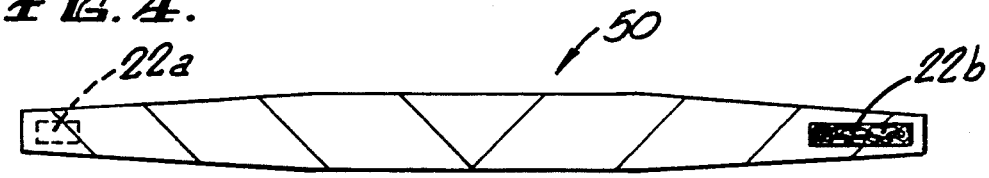
FIG. 5 is a front plan view of a sweatband according to present invention, where the cloth element is rolled to have a bandanna appearance.

As shown in FIG. 5, the cloth segment used for forming the sweatband 10 can be rolled up to simulate a bandanna, before it is stitched together. Thus the sweatband 50 can have all of the attractiveness of a bandanna, with the water-absorption comfort characteristics of a synthetic foam sponge.

Figure 6:
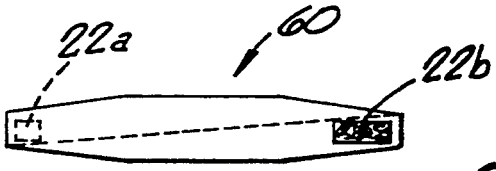
FIG. 6 is a wristband according to the present invention.

The sweatband 10 is not limited to use as a headband. As shown in FIG. 6, a wristband 60 according to the present invention has substantially the same construction as the headband 10 shown in FIG. 1, except it is shorter in length; particularly the end segments are very short so that the water-absorber can enclose the entire wrist of the user.

The sweatband 10 is very easy to use. All that is necessary is to wrap it around a body part, and secure the two end portions together, either by tying or pinning the two end portions together, or when fastener strips 22 are provided, by attaching the two fastener strips 22 to each other.

Thus, a sweatband according to the present invention provides the functionality of conventional sweatbands, with more comfort, increased absorbency, and better aesthetics.

Although the present invention has been described in considerable detail with reference to certain preferred versions thereof, other versions are possible. For example, the water-absorber need not be one continuous element, but rather can be a series of discrete elements retained by the cloth element. Moreover, the water-absorber can be retained by the cloth element not only by forming a tubular space for it; retention can be effected by an adhesive, stitching, and/or a fastener, in addition to or instead of the tubular space. Therefore, the scope of the appended claims should not be limited to the description of the preferred versions contained herein.

What is claimed is:

1. A sweatband comprising:

a) an elongated, decorative, cloth element made of a material capable of transmitting water, the cloth element rolled to simulate a rolled bandana and stitched in that configuration, the cloth element having opposed, tapered end portions, and the cloth element being sufficiently long to extend around a body part; and b) a water-absorber retained by the cloth element, the water-absorber being sufficiently flexible to conform to the body part, wherein the sweatband can be placed around the body part and the cloth element end portions can be secured together so that the band can absorb sweat from the body part, sweat transmitting through the cloth element into the water-absorber.

2. The sweatband of claim 1 wherein the body part is a head and the cloth element is sufficiently long to be placed around the head for the sweatband to serve as a headband.

3. The sweatband of claim 1 sized to be a wrist band.

4. The sweatband of claim 1 wherein the cloth element comprises a tubular portion containing the water-absorber.

5. The sweatband of claim 4 wherein the cloth element is formed of a stretchable material.

6. The sweatband of claim 5 wherein the stretchable material comprises spandex and a fibrous material.

7. The sweatband of claim 5 wherein the fibrous material is cotton.

8. The sweatband of claim 1 wherein the end portions are sufficiently long that they can be tied together.

9. The sweatband of claim 1 including synthetic material that can be fastened to itself on the end portions for securing the end portions together.

10. The sweatband of claim 1 wherein the water-absorber comprises synthetic foam.

11. The sweatband of claim 1 wherein the tapered cloth element end portions are widest proximate to the water-absorber.

12. The sweatband of claim 11 wherein the water-absorber has opposed end portions and a central portion therebetween, wherein the width of the water-absorber end portions is less than the width of the water-absorber central portion.

13. A sweatband comprising:

a) an elongated, decorative, exterior, stretchable cloth element made of a material capable of transmitting water, the cloth element rolled to simulate a rolled bandana and stitched in that configuration, the cloth element comprising opposed, tapered end portions and a retaining portion between the end portions, and the cloth element being sufficiently long to be placed around a body part; and b) a separate water-absorber retained by the retaining portion of the cloth element, the water-absorber being sufficiently flexible to conform to the body part;

wherein the sweatband can be wrapped around the body part and the end portions can be secured together so that the band can absorb sweat from the body part, sweat transmitting through the cloth element into the water-absorber.

14. The sweatband of claim 13 wherein the width of the cloth element end portions is less than the width of the cloth element retaining portion.

15. The sweatband of claim 13 wherein the water-absorber has opposed end portions and a central portion therebetween, wherein the width of the water-absorber end portions is less than the width of the water-absorber central portion.

16. A sweatband comprising:

a) an elongated, decorative, stretchable cloth element made of a material capable of transmitting water, the cloth element rolled to simulate a rolled bandana and stitched in that configuration, the cloth element comprising opposed, tapered end portions and a tubular retaining portion between the end portions, and the cloth element being sufficiently long to be placed around a body part;

b) a separate elongated water-absorber retained within the retaining portion of the cloth element, the water-absorber being sufficiently flexible to conform to the body part; and c) a connector for connecting the cloth element end portions together when the band is wrapped around the body part so that the band can absorb sweat from the body part, sweat transmitting through the cloth element into the water-absorber;

wherein the ends of the water-absorber are tapered and the width of the tapered cloth element end portions are a sufficient amount less than the width of the cloth element retaining portion that when the sweatband is placed around a body portion the cloth element does not pucker.

* * * * *